United States Patent [19]

Yamashita, Toshinori

[11] 4,122,747

[45] Oct. 31, 1978

[54] LUG ASSEMBLY FOR ANCHORING DRUM HEADS TO DRUM BODY

[75] Inventor: Yamashita, Toshinori, Hamamatsu, Japan

[73] Assignee: Nippon Gakki Seizo Kabushiki Kaisha, Hamamatsu, Japan

[21] Appl. No.: 817,971

[22] Filed: Jul. 22, 1977

[30] Foreign Application Priority Data

Jul. 24, 1976 [JP] Japan ..... 51/99143[U]

[51] Int. Cl.[2] ..... G10D 13/02

[52] U.S. Cl. ..... 84/411 R; 84/413

[58] Field of Search ..... 84/411, 413, 415–417, 84/420

[56] References Cited

U.S. PATENT DOCUMENTS

| | | | |
|---|---|---|---|
| 2,092,980 | 9/1937 | Ludwig | 84/411 R |
| 3,019,685 | 2/1962 | Davis | 84/411 R |
| 3,865,003 | 2/1975 | Della-Porta | 84/411 R |
| 3,955,465 | 5/1976 | Zickos | 84/411 R |

*Primary Examiner*—Lawrence R. Franklin

*Attorney, Agent, or Firm*—Lerner, David, Littenberg & Samuel

[57] ABSTRACT

A lug assembly for stretching drum heads by using lug bolts, including a bushing adapted for screw engagement with the lug bolt, a seat and an elastic insert which are received in corresponding grooves formed in an extension member. The extension member is formed on an inner wall of the casing, and the elements are resiliently wedged against movement as a result of the biasing force of the elastic insert and as a result of the cooperating contours of the elements with the associated grooves. As a result, conventional metallic moise, caused by vibration upon beating of the drum heads, is successfully eliminated.

11 Claims, 11 Drawing Figures

LUG ASSEMBLY FOR ANCHORING DRUM HEADS TO DRUM BODY

BACKGROUND OF THE INVENTION

The present invention relates to an improved lug assembly for drums, and more particularly relates to an improved construction of a lug assembly used for stretching drum heads in which a bushing for a lug bolt is resiliently locked against movement within a casing by the biasing force of an associated elastic element.

In one example of the conventional lug assembly of the above-described type, a compression coil spring is used to lock the bushing against movement caused by beating the drum by fastening the lug bolt for stretching the drum head. Within the casing, a flange of the bushing is resiliently pressed against the inner wall of the casing by the compression spring. This resilient locking mechanism for the bushing is accompanied by fatal metallic noise trouble which seriously degrades the acoustic effect of the drums for which the lug assembly is used. When the drum head is beaten, vibration of the drum head is transmitted to the casing via the body of the drum to which the lug assembly is mounted and generates inductive vibrations of the compression coil spring itself and the associated bushing. That is, the windings of the coil spring crash into each other and the flange of the bushing crashes against the inner wall of the casing to generate metallic noises irritating to the ears. The detrimental effect of such metallic noises upon the acoustic effect of the drums for which the lug assembly is used is larger than the damping characteristics of the springs which are in general very poor.

In another example of the conventional lug assembly, it is proposed to substitute an elastic piece for the compression spring in order to press the flange of the bushing against the inner wall of the casing. This construction may be free from the metallic noise trouble caused by mutual crashing of the windings composing the coil spring as the drum head is beaten. However, even this proposed construction cannot be free from the metallic noise trouble caused by crashing of the flange of the bushing against the inner wall of the casing, as the flange of the bushing is arranged within the casing in direct contact with the inner wall of the casing.

Usually, a pair of lug assemblies are provided for drums such as base drums provided with two bushings adapted for screw engagement with a pair of lug bolts for stretching drum heads, respectively. With such a drum, sometimes only one drum head is used in a stretched state and the remaining drum head is removed. Then, one of the two bushings is left free without engagement with the associated lug bolt. When the drum head is beaten with this free state of the bushing, the bushing tends to vibrate more actively than when same is in screw engagement with the cooperating lug bolt and this active vibration of the bushing apparently operates to amplify the metallic noise trouble.

Such conventional lug assemblies have a further defect in effectively preventing the lug bolt from loosening against screw engagement with the bushing.

SUMMARY OF THE INVENTION

The primary object of the present invention is to provide a lug assembly for drums which is quite free from metallic noise trouble conventionally caused by vibration of the bushing and/or elastic element for resiliently urging the bushing.

The other object of the present invention is to provide a lug assembly for drums which generates substantially no metallic noises even when the bushing is disengaged from the cooperating lug bolt for stretching the drum head.

A further object of the present invention is to provide a lug assembly for anchoring drum heads which effectively prevents the lug bolt from loosening against screw engagement with the bushing.

A still further object of the present invention is to provide a lug assembly in which quick fatigue of the elastic element for urging the bushing is effectively prevented.

In accordance with the present invention, a hollow casing is provided with at least one corner bulge or extension formed therein which is provided with outer, intermediate and inner grooves. A bushing adapted for screw engagement with a lug bolt has an end flange received in the intermediate groove, an elastic insert is received in the outer groove while inserted over the cylindrical portion of the bushing, and a seat is received in the inner groove. The bushing and the seat are wedged against movement in the casing due to the forces of repulsion of the elastic insert which is compressively clamped between one operational end wall of the casing and the end flange of the bushing. Preferably, side contours of the bushing flange, the elastic insert and the seat coincide with those of the associated grooves. When the casing is provided with two extensions and their related elements, the lug assembly is usable for stretching two drum heads simultaneously.

In the following description, explanation will be made to the lug assembly in a disposition to be mounted to drums and, hence expressions such as upper and lower substitute for the expressions such as outer and inner, respectively.

DESCRIPTION OF THE PREFERRED EMBODIMENTS

Figure 1:
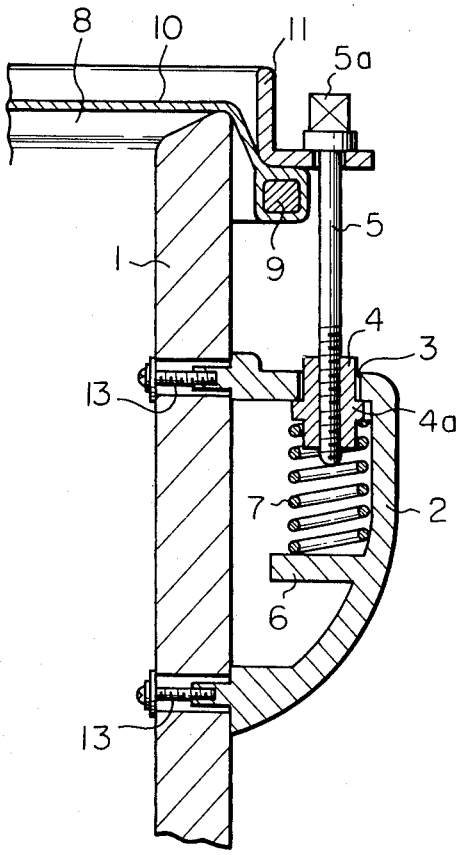
Fig. 1 PRIOR ART
FIG. 1 is a side sectional view of one example of the conventional lug assembly mounted to a drum.

One typical example of the conventional lug assembly for drums is shown in FIG. 1 in a cross section, in which the lug assembly includes a hollow casing 2 detachably fixed to main body 1 of a drum via screws 13. A through-hole 3 is formed in the upper wall of the casing 2 and a bushing 4 is inserted in the through-hole 3 in such an arrangement that an intermediate flange 4*a* of the bushing 4 is positioned under the lower opening of the through-hole 3. The diameter of the flange 4*a* is larger than that of the through-hole 3. A lug bolt 5 is in screw engagement with the bushing 4 at the lower end portion thereof. A shelf 6 is formed substantially horizontally projecting from the inner wall of the casing 2 at a position somewhat below the lower end of the bushing 4 and a compression spring 7 is provided with its upper end abutting the flange 4*a* of the bushing and its lower end resting on the shelf 6. The upper open end 8 of the drum is closed by a drum head 10 carried along the peripheral fringe thereof by a rib 9 in properly stretched state. A wall section 11 is inserted over the fringe of the drum head 10 and the above-described lug bolt 5 is in engagement with the wall section 11 at the upper end portion thereof. The lug bolt 5 is provided with an angled head 5*a* adapted for axially turning the bolt 5 by a suitable instrament such as a wrench.

By fastening the lug bolt 5 with this construction, i.e., by axially turning the lug bolt 5 in such a direction that the lug bolt 5 moves downwardly with respect to the bushing 4, the drum head 10 is stretched.

When the drum head 10 is beaten with the construction of the lug assembly, vibrations of the drum head 10 and the main body 1, when beaten, inevitably induces accompanied vibration of the compression spring 7 for pressing the bushing 4. This vibration of the spring 7 often causes, firstly, violent crashing of the windings of the coil spring 7 against each other, and secondly, violent crashing of the spring 7 against the inner wall of the casing 2. These crashings inevitably generate undesirable metallic noises which seriously degrade quality of tones produced by drums and jar upon the players' ears. In addition such noises tend to last rather long dut to the relatively poor damping characteristics of the spring vibration.

The problem arising from the spring vibration is more serious when the lug assembly is used for snare drums. In such cases where a pair of lug assemblies are to be used for one drum, there are two sets of lug bolts and their associated elements arranged about the upper and lower sides of the drum, one set being adapted for stretching the upper drum head and the other for stretching the lower drum head. Under some situations, the drum is played with its lower drum head being removed. In this case, the lower side lug bolt is left free or removed from the lug assembly. In this case, at least the bushing and the compression spring are left free in the casing. With this absence of restriction on the dynamic behaviors of these elements, vibrations of the drum head and the main body, when beaten, induces enlarged vibrations of the spring and the bushing while resulting in increased metallic noise trouble.

Figure 2:
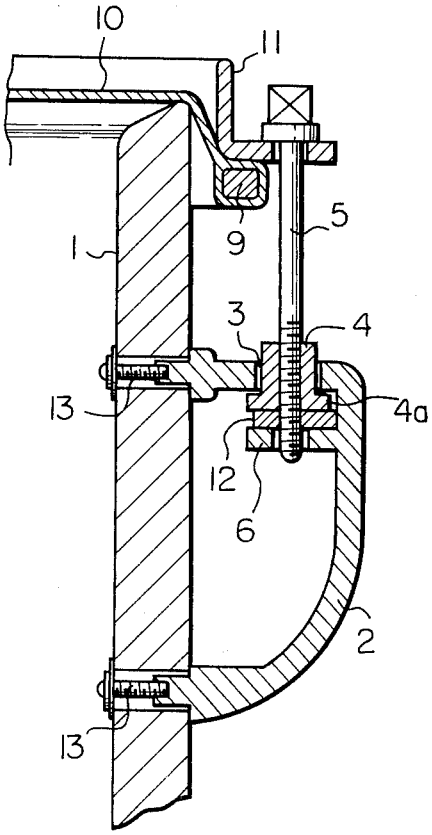
Fig. 2 PRIOR ART
FIG. 2 is a side sectional view of another example of the conventional lug assembly mounted to a drum.

An improvement has been proposed in order to mitigrate such a metallic noise trouble to be caused by the vibration of the drum head when beaten, which is shown in FIG. 2. In the case of this improved lug assembly, the shelf 6 is located rather close to the upper wall of the casing 2 and the compression spring 7 used in the lug assembly shown in FIG. 1 is omitted and the bushing 5 downwardly terminates at the flange 4*a*. As a substitute for the compression spring, a non-metallic elastic insert 12 is inserted between the bottom surface of the bushing flange 4*a* and the top surface of the shelf 6. The shelf 6 of this example is provided with a through hole and the lower end portion of the lug bolt 5 extends through the elastic insert 12 and the shelf 6. The function of the elastic insert 12 is quite the same as that of the compression spring 7 used for the lug assembly shown in FIG. 1 but, as it is made of a non-metallic material such as rubber, generation of metallic noise upon beating of the drum head can be seccessfully obviated as far as the repulsive behavior of the elastic insert 12 itself is concerned. However, even the lug assembly of this type cannot be free from generation of metallic noise caused by crashing of the bushing flange 4*a* against the top wall of the casing 2, which occurs as the screw engagement between the lug bolt 5 and the bushing 4 is loosened due to vibration of the drum main body 1 and the bushing 4 moves even a little into the casing 2.

Figure 3A:
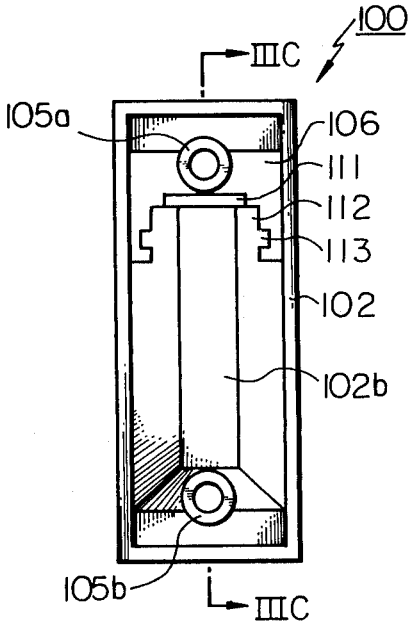
FIGS. 3A through 3C are front, side and side sectional views of one embodiment of the lug assembly in accordance with the present invention.
Figure 3B:
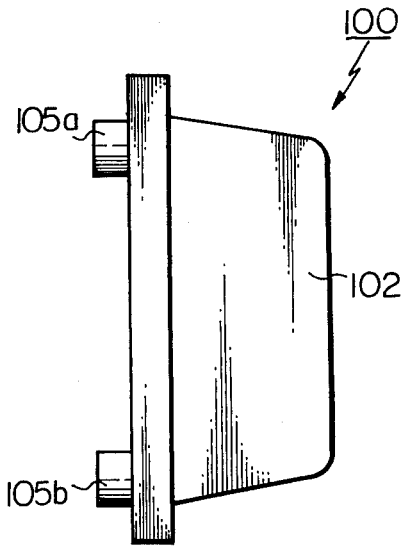
Figure 3C:
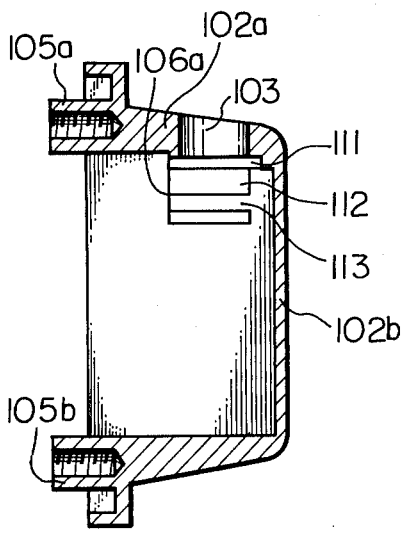
Figure 5A:
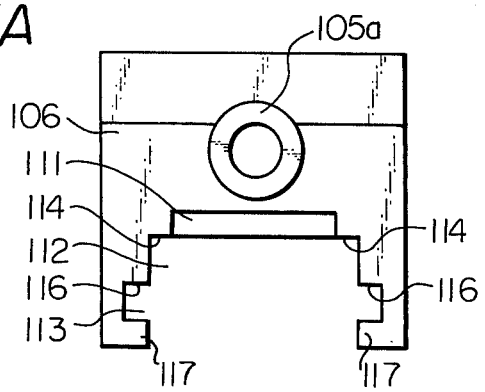
FIG. 5A is a front view of a corner bulge of the lug assembly shown in FIGS. 3A through 3C with the bushing and its associated elements being removed for easy understanding of the construction.
Figure 6:
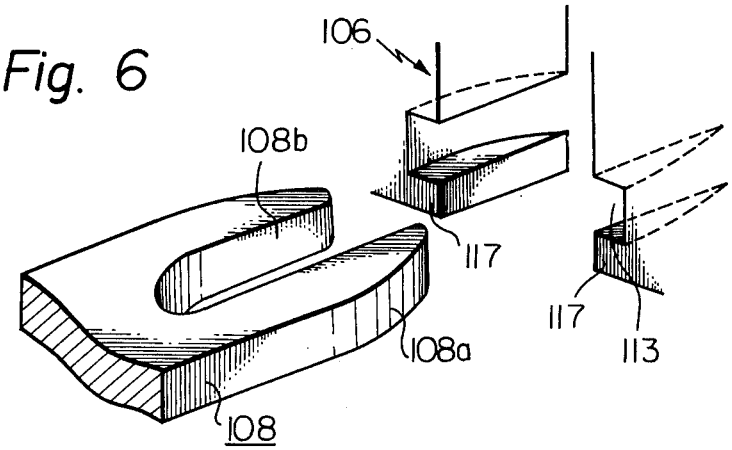
FIG. 6 is an explanatory perspective view of the seat and the groove receptive of the seat.

One embodiment of the lug assembly in accordance with the present invention is shown in FIGS. 3A through 3C, which is adapted for stretching one drum head only. The lug assembly 100 includes a hollow casing 102 having a pair of upper and lower projections 105*a* and 105*b* on the open side thereof each of which is provided with a threaded hole for screw engagement with set screws (not shown) for fixing the casing 102 to the body of a drum for which the lug assembly 100 is to be used. Like conventional ones, the casing 102 is provided with a through hole 103 formed in the top wall 102*a* thereof. Adjacent this through hole 103, a corner bulge or extension 106 is formed on the upper inner corner of the casing 102 which has a forehead or member 106*a* extending substantially parallel to the open end of the casing 102 and positioned somewhat inwardly of the open end. As best seen in FIGS. 3A and 3C, the corner bulge 106 is provided with an uppermost horizontal groove 111 opening in the forehead 106*a* thereof and extending towards the rear wall 102*b* thereof. The above-described through hole 103 downwardly opens in the uppermost horizontal groove 111. An intermediate horizontal groove 112 is formed beneath the uppermost horizontal groove 111 while opening in the forehead 106*a* and extending towards the rear wall 102*b* of the casing 102. The width of this intermediate horizontal groove 112 is somewhat larger than that of the uppermost horizontal groove 111. Thus, as best seen in FIG. 5A, steps 114 are formed at the border between the uppermost and intermediate horizontal grooves 111 and 112. A lowermost horizontal groove 113 is formed beneath the intermediate horizontal groove 112 while opening in the forehead 106*a* of the corner bulge 106 and extending towards the rear wall 102*b* of the casing 102. The width of the lowermost horizontal groove 113 is larger than that of the intermediate horizontal groove 112. Thus, steps 116 are formed at the border between the intermediate and lowermost horizontal grooves 112 and 113. A pair of side shelves 117 are formed to define the lower border of the lowermost horizontal groove 113. The side walls defining the lowermost horizontal groove 113 converge roungly towards the rear wall 102*b* of the casing 102. (see FIG. 6)

Figure 4:
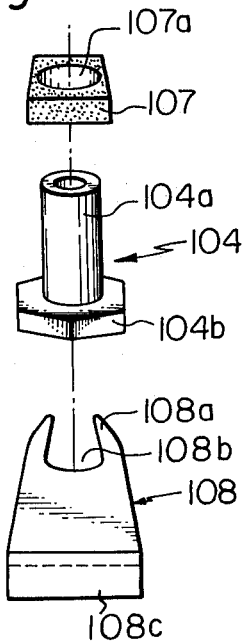
FIG. 4 is a perspective view of a bushing and its associated elements used for the lug assembly shown in FIGS. 3A through 3C in a disassembled state.

The lug assembly 100 is further provided with an elastic insert 107, a bushing 104 and a seat 108 which are shown in FIG. 4 in a disassembled disposition.

The elastic insert 107 is made of an elastic material such as rubber. The width of the elastic insert 107 should not be larger than that of the uppermost horizontal groove 111 of the casing 102 and the thickness of the elastic insert 107 should be larger than the height of the uppermost horizontal groove 111 of the casing 102. The elastic insert 107 is provided with a center through hole 107*a* for the purpose hereinafter described.

The bushing 104 is provided with a cylindrical portion 104*a* and a bottom flange 104*b* having angled side surfaces. The thickness of the bottom flange 104*b* should be smaller than the height of the intermediate horizontal groove 112 and contour of the bottom flange 104*b* should be so designed that same can be received in the intermediate horizontal groove 112 in an axially immovable fashion.

The seat 108 is provided with a converged round end 108*a* having a longitudinal cut-out 108*b*. The thickness of the seat 108 should be smaller than that of the lowermost horizontal groove 113 and the contour of the seat 108 should be so designed that it can be received in the lowermost horizontal groove 113 in a laterally immovable fashion. The length of the seat 108 should preferably be so designed that the flat end 108*c* thereof is positioned about the open end of the casing 102 when it is fully inserted into the lowermost horizontal groove 113.

In the assembled state of the lug assembly 100 in accordance with the present invention, the elastic insert 107 is received in the uppermost horizontal groove 111 while hole 107*a* has inserted there through the cylindrical position 104*a* of the bushing 104 which extends through the through hole 103 and outwardly of the top wall 102*a* of the casing 102. The bottom flange 104*b* of the bushing 104 is axially immovably received in the intermediate horizontal groove 112. The seat 108 is laterally immovably received in the lowermost horizontal groove 113. The assembled disposition of the lug assembly 100 relative to the three horizontal grooves 111, 112 and 113 is fragmentarily shown in FIG. 5B where the lug bolt (see FIGS. 1 and 2) is loosen.

In this disposition wherein the lug bolt is loosen, no compression is applied to the elastic insert 107. So, the elastic insert 107 assumes the largest thickness and partly projects into the intermediate horizontal groove 112. Accordingly, the bottom flange 104*b* of the bushing 104 partly projects into the lowermost horizontal groove 113 and the seat 108 is pressed against the side shelves 117. Thus, all the assembled elements 104, 107 and 108 are immovably wedged to the corner bulge 106 of the casing 102.

As the lug bolt is fastened for stretching the drum head, the bushing 104, i.e., the bottom flange 104*b* moves upwardly and the elastic insert 107 is compressed accordingly. According to the extent of compression, the thickness of the elastic insert 107 is reduced and its invasion into the intermediate horizontal groove 112 decreases. In this compressed disposition, the elastic insert 107 exerts force upon the associated elements 104 and 108 due to its repulsion. This repulsion force effectively prevents the bushing 104 from loosening against screw engagement with the lug bolt 5. The seat 108 is pressed against the side shelves 117 and the botom flange 104*b* is pressed between the elastic insert 107 and the seat 108. Thus, all the cooperating elements 104, 107 and 108 are wedged to the corner bulge 106 against vertical movement. Coincidence between the contours of the lowermost groove 113 and the converged end 108*a* of the seat 108 effectively wedges the seat 108 against lateral movement. Thus, even when the drum head is beaten and vibration of the drum head is transmitted to the casing 102 via the body of the drum, substantially no accompanying vibrations of the elements 104, 107 and 108 are induced and the metallic noise trouble is successfully alleviated.

Figure 5B:
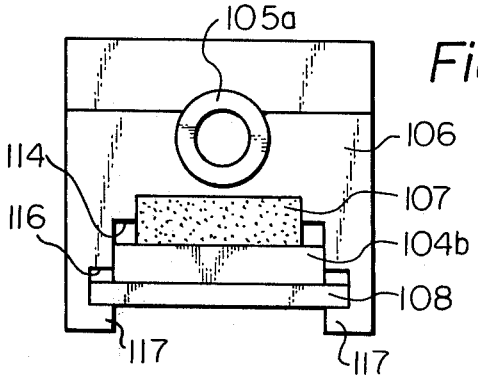
FIG. 5B is a front view of the corner bulge shown in FIG. 5A with the bushing and its related elements being arranged in position.
Figure 5C:
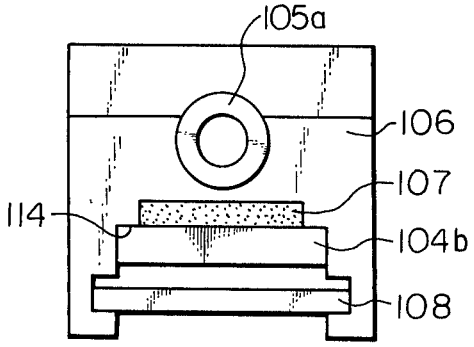
FIG. 5C is a front view of the corner bulge in which the elastic insert is compressed to maximum extent.

In the disposition shown in FIG. 5C, the elastic insert 107 is compressed to the maximum and further compression of the elastic insert 107 is limitted as the bottom flange 104*b* of the bushing 104 abuts against the step 114 formed at the border between the uppermost and intermediate horizontal grooves 111 and 112. This limitted compression of the elastic insert 107 ideally prevents accelerated fatigue of the elastic insert 107 to be caused by excessive compression of same.

When two drum heads are anchored to one drum by a pair of lug assemblies 100 of this embodiment, the dispositions of the corner bulges and their associated elements are both substantially similar to that shown in FIG. 5B, the elastic inserts being in more compressed state. When only one drum head, e.g., only the upper drum head, is stretched and the other drum head is removed from the drum, the bushing 104 of the upper corner bulge 106 is in screw engagement with the lug bolt 5 and the bushing 104 of the lower corner bulge 106 is left free. The disposition of the lower corner bulge 106 and its associated elements in this free state is quite the same with that shown in FIG. 5B, in which the elements 104, 107 and 108 are wedged firmly against movement due to the repulsion of the elastic insert and the above-described coincidence in contour between the elements and the cooperating horizontal grooves. Thus, even in the free state, the lug assembly is quite free from the metallic noise trouble to be caused by induced vibration of the elements 104 and 108.

Figure 7:
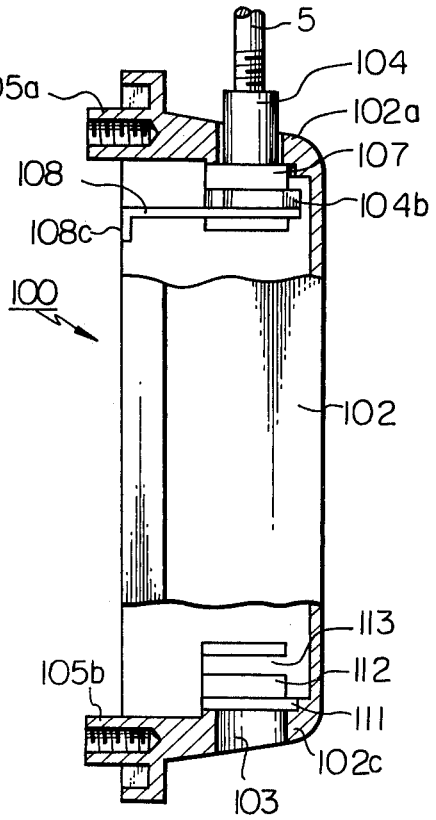
FIG. 7 is a side view, partly in section, of a modified embodiment of the lug assembly in accordance with the present invention adapted for stretching two drum heads simultaneously.

Another embodiment of the lug assembly in accordance with the present invention is shown in FIG. 7, which is usable for snare drums. The lug assembly 100 is provided with a pair of through holes 103 formed in the upper and bottom walls 102*a* and 102*c*, respectively. The lug assembly 100 is provided with upper and lower corner bulges 106. Just like the foregoing embodiment, the upper corner bulge 106 is provided with an uppermost horizontal groove 111 for the elastic insert 107, an intermediate horizontal groove 112 for the bottom flange 104*b* of the bushing 104 and a lowermost groove 113 for the seat 108. The length of the seat 108 is so selected that, when the seat 108 is fully inserted into the lowest groove 113, its downwardly bent end 108*c* lightly abuts the body of the drum for which the lug assembly is to be used. In a substantially similar but mirror image fashion, the lower corner bulge 106 is provided with a lowermost horizontal groove 111 for the elastic insert 107, an intermediate horizontal groove 112 for the flange 104*b* of the bushing 104 and an uppermost groove 113 for the seat 108.

In the disposition shown in FIG. 7, the bushing 104 and its related elements 107 and 108 are removed from the lower corner bulge 106 in order to clearly show the arrangement of the three grooves 111 through 113 formed therein. When the lug assembly 100 is attached to drums, the elements 104, 107 and 108 are naturally incorporated in the construction of the lower corner bulge 106 in a fashion substantially similar to that shown in FIG. 5B.

As is clear from the foregoing description, the elements of the lug assembly in accordance with the present invention for cooperating with the lug bolt are all firmly wedged within the casing against movement due to the repulsion of the elastic insert(s) and the contour coincidence between the elements and the cooperating grooves. So, even when the drum head or heads are beaten very furiously, vibration of the head cannot induce accompanying vibration of the above-described elements, thereby quite seccessfully avoiding the metallic noise trouble. Even when the bushing is set free from screw engagement with the lug bolt for stretching the drum head, the repulsion of the elastic insert effectively wedges the bushing and the seat against vibration and substantially no metallic noises are generated. Limited compression of the elastic insert effectively prevents quick fatigue of the elastic insert by fastening of the lug bolt. Elongated construction of the seat assures easy access to and handling of the seat in assembling and disassembling the lug assembly in accordance with the present invention.

I claim:

1. An improved lug assembly for drums comprising, in combination, a hollow casing having an opening on the side thereof, a side wall spaced apart from said opening and at least one operational end wall connected to said side wall, said operational end wall being provided with a through-hole, an inner extension formed within said casing at a position adjacent to said through-hole and having a member facing said opening, said extension being further provided with an outer groove opening to said through-hole, an intermediate groove extending adjacent to and in communication with said outer groove, an inner groove extending adjacent to and in communication with said intermediate groove, and a pair of shelves extending adjacent to said inner groove to partly define the innermost border of said inner groove, a bushing having an end flange received in said intermediate groove and a cylindrical portion extending outwardly of said casing through said through-hole, a non-metallic elastic insert inserted over said cylindrical portion of said bushing and compressively received in said outer groove, a seat received in said inner groove and extending towards said opening of said casing, and a lug bolt in screw engagement at one end thereof with said cylindrical portion of said bushing and adapted at the other end thereof for anchoring the drum head to the body of the drum.

2. The improved lug assembly as claimed in claim 1 in which said intermediate groove has a width larger than that of said outer groove.

3. The improved lug assembly as claimed in claim 2 in which said inner groove has a width larger than that of said intermediate groove.

4. The improved lug assembly as claimed in claim 2 in which the thickness of said elastic insert in the free state is larger than the height of said outer groove measured at right angle to the extending direction thereof.

5. The improved lug assembly as claimed in claim 4 in which the side contour of said elastic insert substantially coincides with that of said outer groove so that said elastic insert is snugly and immovably received in said outer groove.

6. The improved lug assembly as claimed in claim 1 in which said inner groove has a width larger than that of said intermediate groove.

7. The improved lug assembly as claimed in claim 1 in which the side contour of said end flange of said bushing substantially coincides with that of said cintermediate groove so that said bushing is wedged against axial movement.

8. The improved lug assembly as claimed in claim 7 in which said inner groove is converged towards said side wall and said seat is provided with a converged end.

9. The improved lug assembly as claimed in claim 1 in which the side contour of said seat substantially coincides with that of said inner groove so that said seat is snugly and immovably received in said inner groove.

10. The improved lug assembly as claimed in claim 1 in which said seat is provided with an end located close to said opening of said casing.

11. The improved lug assembly as claimed in claim 1 in which said casing is provided with a pair of extensions and their associated elements adapted for stretching two drum heads simultaneously.

* * * * *

UNITED STATES PATENT AND TRADEMARK OFFICE

CERTIFICATE OF CORRECTION

PATENT NO. : 4,122,747

DATED : October 31, 1978

INVENTOR(S) : Yamashita, Toshinori, Hamamatsu

It is certified that error appears in the above-identified patent and that said Letters Patent are hereby corrected as shown below:

Column 3, Line 39, the word "dut" should read --due--

Column 3, Line 66, the figure "5" should read --4--

Column 7, Line 3, the word "seccessfully" should read --successfully--

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*